US009633619B2

(12) United States Patent
Xu

(10) Patent No.: US 9,633,619 B2
(45) Date of Patent: Apr. 25, 2017

(54) CAPACITIVE VOLTAGE DIVIDING LOW COLOR SHIFT PIXEL CIRCUIT

(71) Applicant: Shenzhen China Star Optoelectronics Technology Co., Ltd., Shenzhen (CN)

(72) Inventor: Hongyuan Xu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 131 days.

(21) Appl. No.: 14/758,956

(22) PCT Filed: May 13, 2015

(86) PCT No.: PCT/CN2015/078827
§ 371 (c)(1),
(2) Date: Jul. 1, 2015

(87) PCT Pub. No.: WO2016/149995
PCT Pub. Date: Sep. 29, 2016

(65) Prior Publication Data

US 2017/0039966 A1 Feb. 9, 2017

(30) Foreign Application Priority Data

Mar. 23, 2015 (CN) ..... 2015 1 0129863

(51) Int. Cl.
*G09G 3/36* (2006.01)
*G09G 3/20* (2006.01)

(52) U.S. Cl.
CPC ..... *G09G 3/3648* (2013.01); *G09G 3/2003* (2013.01); *G09G 2300/0426* (2013.01); *G09G 2300/0876* (2013.01); *G09G 2320/0242* (2013.01)

(58) Field of Classification Search
CPC ..... G09G 3/3648; G09G 3/2003; G09G 2300/0426
USPC ..... 345/87
See application file for complete search history.

(56) References Cited

U.S. PATENT DOCUMENTS

2009/0040413 A1* 2/2009 Chen ..... G02F 1/13624 349/48
2012/0026447 A1* 2/2012 Xi ..... G02F 1/136213 349/144

* cited by examiner

*Primary Examiner* — Jonathan Blancha
(74) *Attorney, Agent, or Firm* — Leong C. Lei

(57) ABSTRACT

The present invention provides a capacitive voltage dividing low color shift pixel circuit, which is electrically coupled to the main area (Main) of the sub pixel with a data signal line (Data) and provides a main data signal voltage thereto, and the data signal line (Data) is coupled to a common electrode line (Com) via a first capacitor (C1) and a second capacitor (C2) in series, and a routing (L) is led out between the first capacitor (C1) and the second capacitor (C2), and is electrically coupled to the sub area (Sub) and provides a sub data signal voltage thereto; with voltage dividing function of the first capacitor (C1) and the second capacitor (C2), the sub data signal voltage is different from the main data signal voltage. It can be realized to input different data signal voltages to the main area (Main) and the sub area (Sub) of the sub pixel with one data signal line (Data) to perform multi-domain display. The color shift issue of VA type liquid crystal display can be improved and the amounts of the data signal lines and the COFs are not increased.

16 Claims, 3 Drawing Sheets

CAPACITIVE VOLTAGE DIVIDING LOW COLOR SHIFT PIXEL CIRCUIT

FIELD OF THE INVENTION

The present invention relates to a display technology field, and more particularly to a capacitive voltage dividing low color shift pixel circuit.

BACKGROUND OF THE INVENTION

The Liquid Crystal Display (LCD) possesses advantages of thin body, power saving and no radiation to be widely used in many application scope. Such as LCD TV, mobile phone, personal digital assistant (PDA), digital camera, notebook, laptop, and dominates the flat panel display field.

Most of the liquid crystal displays on the present market are back light type liquid crystal displays, which comprise a shell, a liquid crystal display panel located in the shell and a backlight module located in the shell. The liquid crystal display panel is a major component of the liquid crystal display. However, the liquid crystal display panel itself does not emit light and needs the back light module to provide light source for normally showing images.

Generally, the liquid crystal display panel comprises a Color Filter (CF), a Thin Film Transistor Array Substrate (TFT Array Substrate) and a Liquid Crystal Layer positioned between the two substrates. Meanwhile, pixel electrodes, common electrodes are provided respectively at relative inner sides of the two substrates. The light of back light module is reflected to generate images by applying voltages to control the liquid crystal molecules to be changed directions.

The liquid crystal displays have kinds of display types, including Twisted Nematic (TN) type, Electrically Controlled Birefringence (ECB) type, Vertical Alignment (VA) type and et cetera. The VA type is a common display type with benefits of high contrast, wide view angle and rubbing alignment free. However, because the VA type utilizes vertical twist liquid crystals and the birefraction difference of the liquid crystal molecules is larger, the issue of the color shift under large view angle is more serious.

Reducing the color shift is the requirement for the development of the VA type liquid crystal displays. At present, the mainstream method of solving the color shift of the VA type liquid crystal displays is multi domain, such as a pixel design of 8 domain display. The twisted angles of the liquid crystal molecules of the 4 domains in the main area (main) and the 4 domains in the sub area (sub) in the same sub pixel are different to improve the color shift. The color shift improvement skill mainly comprises capacitor coupling (CC) technology, charge sharing (CS) technology, common electrode voltage (Vcom) modulation technology, 2D1G/2G1D technology.

Please refer to FIG. 1. FIG. 1 is a diagram of a pixel structure utilizing 2D1G technology according to prior art. As shown in FIG. 1, a plurality of sub pixels arranged in array in a liquid crystal panel, and each sub pixel is divided into a main area Main and a sub area Sub of which the areas are unequal. The main area Main and the sub area Sub in the same row shares the same scan line Gn. The sub pixels in the same column employ two data signal lines Data1, Data2 with different voltages to respectively input data signals to the main area Main and the sub area Sub. Please refer to FIG. 2. FIG. 2 is a diagram of a sub pixel circuit shown in FIG. 1. As shown in FIG. 2, the main area Main comprises a first thin film transistor T1, a first liquid capacitor Old and a first storage capacitor Cst1; the sub area Sub comprises a second thin film transistor T2, a second liquid capacitor Clc2 and a second storage capacitor Cst2. In main area Main, a gate of the first thin film transistor T1 is electrically coupled to the scan line Gn, and a source is electrically coupled to the first data signal line Data1; after the first liquid crystal capacitor Old and the first storage capacitor Cst1 are coupled in parallel, one end is electrically coupled to a drain of the first thin film transistor T1 and the other end is electrically coupled to a constant voltage; in sub area Sub, a gate of the second thin film transistor T2 is electrically coupled to the scan line Gn, and a source is electrically coupled to the second data signal line Data2; after the second liquid crystal capacitor Clc2 and the second storage capacitor Cst2 are coupled in parallel, one end is electrically coupled to a drain of the second thin film transistor T2 and the other end is electrically coupled to a constant voltage. As shown in FIG. 1, FIG. 2, the traditional pixel circuit design can achieve the multi domain display and improves the color shift. However, such design requires to double the amount of the data signal lines, and the amount of the Chip on Films (COF) is also required to be doubled, too. The panel cost will increase.

SUMMARY OF THE INVENTION

An objective of the present invention is to provide a capacitive voltage dividing low color shift pixel circuit to improve the color shift issue of VA type liquid crystal display to reduce the manufacture cost of the liquid crystal panel under the premise without increasing the amounts of the data signal lines and the COFs.

For realizing the aforesaid objective, the present invention provides a capacitive voltage dividing low color shift pixel circuit, and a plurality of sub pixels arranged in array in a liquid crystal panel, and each sub pixel is divided into a main area and a sub area; a scan line is electrically coupled to the main area and the sub area and provides a scan signal thereto; a data signal line is electrically coupled to the main area and provides a main data signal voltage thereto, and the data signal line is coupled to a common electrode line via a first capacitor and a second capacitor in series; a routing is led out between the first capacitor and the second capacitor, and is electrically coupled to the sub area and provides a sub data signal voltage different from the main data signal voltage thereto.

The main area comprises a first thin film transistor, a first liquid crystal capacitor and a first storage capacitor; a gate of the first thin film transistor is electrically coupled to the scan line, and a source is electrically coupled to the data signal line; after the first liquid crystal capacitor and the first storage capacitor are coupled in parallel, one end is electrically coupled to a drain of the first thin film transistor and the other end is electrically coupled to a constant voltage.

The sub area comprises a second thin film transistor, a second liquid crystal capacitor and a second storage capacitor; a gate of the second thin film transistor is electrically coupled to the scan line, and a source is electrically coupled to the routing; after the second liquid crystal capacitor and the second storage capacitor are coupled in parallel, one end is electrically coupled to a drain of the second thin film transistor and the other end is electrically coupled to a constant voltage.

The main area and the sub area respectively comprise four domains.

The data signal line provides the main data signal voltage to the four domains in the main area, and the routing provides the sub data signal voltage to the four domains in the sub area, and with voltage dividing function of the first capacitor and the second capacitor, the relationship of the main data signal voltage and the sub data signal voltage is:

$$V\text{sub}=(C1/(C1+C2))\times(V\text{main}-V\text{com})+V\text{com}$$

wherein Vsub represents the sub data signal voltage, and Vmain represents the main data signal voltage, and C1 represents the first capacitor, and C2 represents the second capacitor, and Vcom represents the common electrode voltage.

The first capacitor and the second capacitor are formed by a second metal layer and a first metal layer.

The first capacitor and the second capacitor are formed by an ITO pixel electrode and a first metal layer.

Sizes of the first capacitor and the second capacitor are respectively determined by areas of the first capacitor and the second capacitor.

The capacitive voltage dividing low color shift pixel circuit alters a data signal voltage difference between the main area and the sub area by changing areas of the first capacitor and the second capacitor.

The present invention further provides a capacitive voltage dividing low color shift pixel circuit, and a plurality of sub pixels arranged in array in a liquid crystal panel, and each sub pixel is divided into a main area and a sub area; a scan line is electrically coupled to the main area and the sub area and provides a scan signal thereto; a data signal line is electrically coupled to the main area and provides a main data signal voltage thereto, and the data signal line is coupled to a common electrode line via a first capacitor and a second capacitor in series; a routing is led out between the first capacitor and the second capacitor, and is electrically coupled to the sub area and provides a sub data signal voltage different from the main data signal voltage thereto;

wherein the main area comprises a first thin film transistor, a first liquid crystal capacitor and a first storage capacitor; a gate of the first thin film transistor is electrically coupled to the scan line, and a source is electrically coupled to the data signal line; after the first liquid crystal capacitor and the first storage capacitor are coupled in parallel, one end is electrically coupled to a drain of the first thin film transistor and the other end is electrically coupled to a constant voltage;

wherein the sub area comprises a second thin film transistor, a second liquid crystal capacitor and a second storage capacitor; a gate of the second thin film transistor is electrically coupled to the scan line, and a source is electrically coupled to the routing; after the second liquid crystal capacitor and the second storage capacitor are coupled in parallel, one end is electrically coupled to a drain of the second thin film transistor and the other end is electrically coupled to a constant voltage.

The benefits of the present invention are: the present invention provides a capacitive voltage dividing low color shift pixel circuit, which is electrically coupled to the main area of the sub pixel with a data signal line and provides a main data signal voltage thereto, and the data signal line is coupled to a common electrode line via a first capacitor and a second capacitor in series, and a routing is led out between the first capacitor and the second capacitor, and is electrically coupled to the sub area and provides a sub data signal voltage thereto; with voltage dividing function of the first capacitor and the second capacitor, the sub data signal voltage is different from the main data signal voltage. It can be realized to input different data signal voltages to the main area and the sub area of the sub pixel with one data signal line to perform multi-domain display. The color shift issue of VA type liquid crystal display can be improved to reduce the manufacture cost of the liquid crystal panel under the premise without increasing the amounts of the data signal lines and the COFs.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
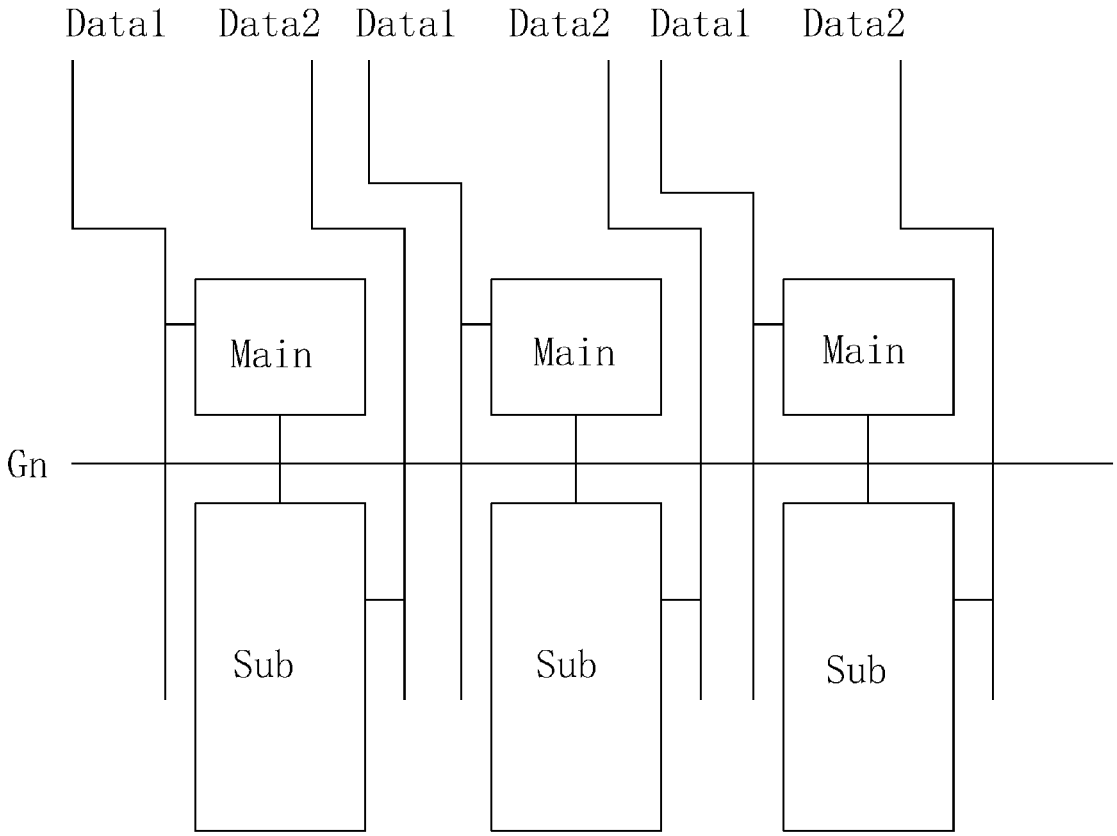
FIG. 1 is a diagram of a pixel structure utilizing 2D1G technology according to prior art.
Figure 2:
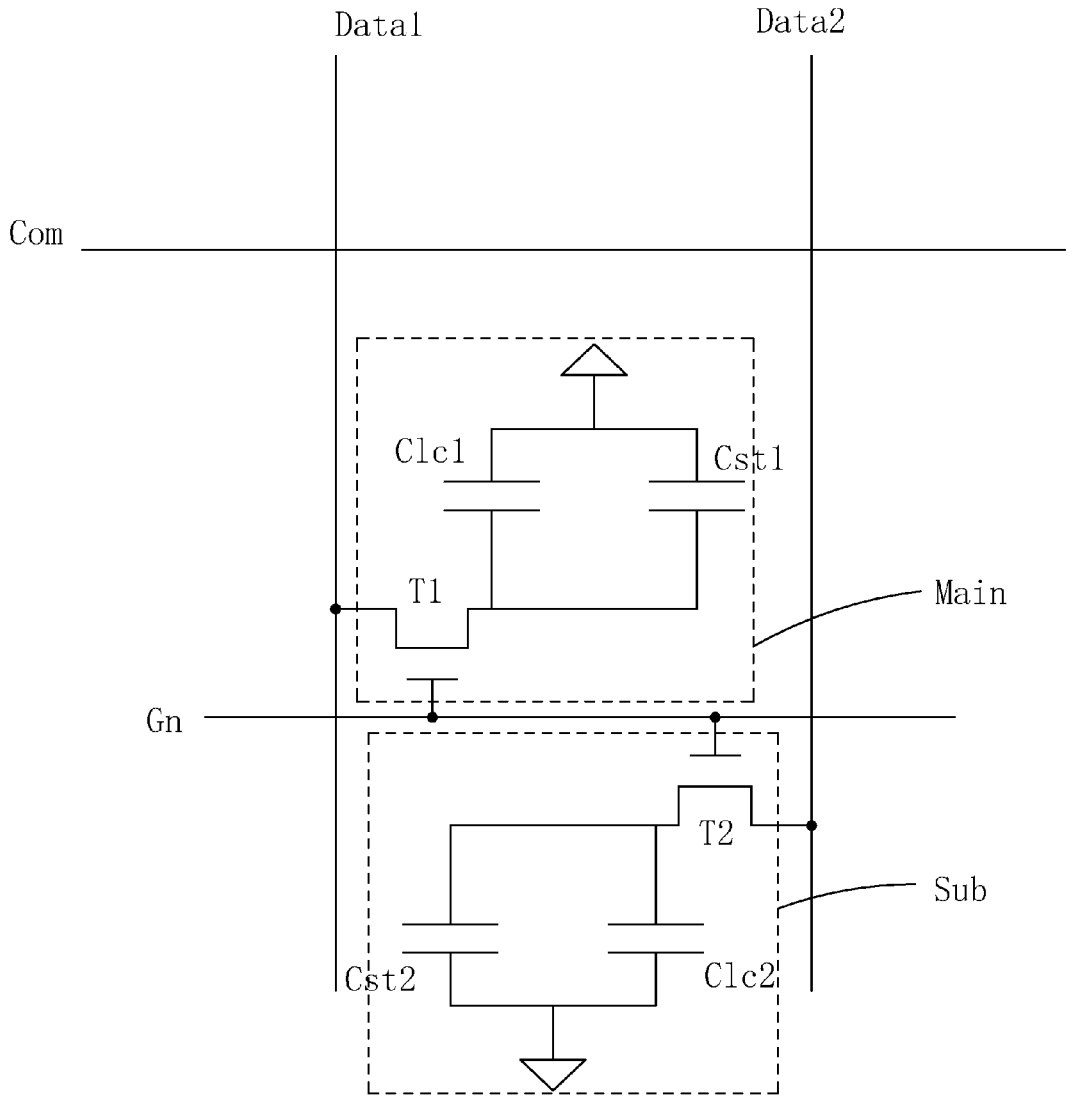
FIG. 2 is a diagram of a pixel circuit utilizing 2D1G technology according to prior art.
Figure 3:
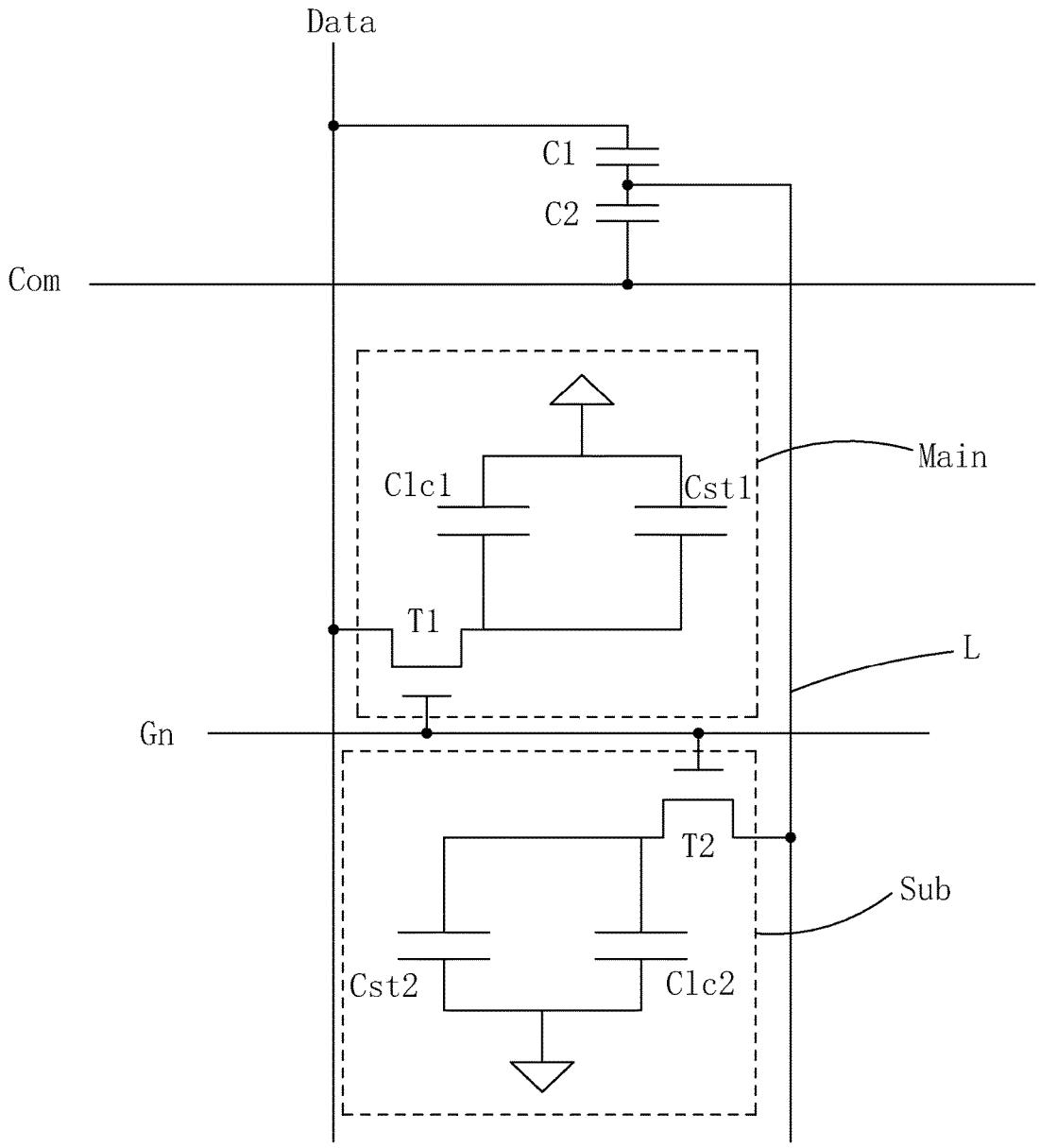
FIG. 3 is a circuit diagram of a capacitive voltage dividing low color shift pixel circuit according to the present invention.

Please refer to FIG. 3. The present invention provides a capacitive voltage dividing low color shift pixel circuit. A plurality of sub pixels arranged in array in a liquid crystal panel, and each sub pixel is divided into a main area Main and a sub area Sub. A scan line Gn is electrically coupled to the main area Main and the sub area Sub and provides a scan signal thereto. A data signal line Data is electrically coupled to the main area Main and provides a main data signal voltage thereto, and the data signal line Data is coupled to a common electrode line Com via a first capacitor C1 and a second capacitor C2 in series. A routing L is led out between the first capacitor C1 and the second capacitor C2, and is electrically coupled to the sub area Sub and provides a sub data signal voltage thereto.

Specifically, the thin film transistor array substrate of the liquid crystal display panel comprises a first metal layer, a second metal layer and an Indium Tin Oxide (ITO) pixel electrode. The first capacitor C1 and the second capacitor C2 can be formed by a second metal layer and a first metal layer or by an ITO pixel electrode and the first metal layer. The specific structures and positions of the first metal layer, the second metal layer and the pixel electrodes are prior arts. No detail description is here. Sizes of the first capacitor C1 and the second capacitor C2 are respectively determined by areas of the first capacitor C1 and the second capacitor C2.

The main area Main comprises a first thin film transistor T1, a first liquid crystal capacitor Old and a first storage capacitor Cst1. A gate of the first thin film transistor T1 is electrically coupled to the scan line Gn, and a source is electrically coupled to the data signal line Data; after the first liquid crystal capacitor Old and the first storage capacitor Cst1 are coupled in parallel, one end is electrically coupled to a drain of the first thin film transistor T1 and the other end is electrically coupled to a constant voltage.

The sub area Sub comprises a second thin film transistor T2, a second liquid crystal capacitor Clc2 and a second storage capacitor Cst2. A gate of the second thin film transistor T2 is electrically coupled to the scan line Gn, and a source is electrically coupled to the routing L; after the second liquid crystal capacitor Clc2 and the second storage capacitor Cst2 are coupled in parallel, one end is electrically coupled to a drain of the second thin film transistor T2 and the other end is electrically coupled to a constant voltage.

Furthermore, the main area Main and the sub area Sub respectively comprise multiple domains. For instance, the main area Main and the sub area Sub respectively comprises four domains. The data signal line Data provides the main data signal voltage to the four domains in the main area Main, and the routing L provides the sub data signal voltage to the four domains in the sub area Sub, and with voltage dividing function of the first capacitor C1 and the second capacitor C2, the relationship of the main data signal voltage and the sub data signal voltage is:

$$V\text{sub}=(C1/(C1+C2))\times(V\text{main}-V\text{com})+V\text{com} \quad (1)$$

wherein Vsub represents the sub data signal voltage, and Vmain represents the main data signal voltage, and C1 represents the first capacitor, and C2 represents the second capacitor, and Vcom represents the common electrode voltage.

Thus it can be seen, the sub data signal voltage is different from the main data signal voltage. The pixel circuit can input different data signal voltages to the main area Main and the sub area Sub of the pixel with merely setting one data signal line Data to perform multi-domain display. The color shift issue of VA type liquid crystal display can be improved to reduce the manufacture cost of the liquid crystal panel without increasing the amounts of the data signal lines and the COFs.

Significantly, sizes of the first capacitor C1 and the second capacitor C2 are respectively determined by areas of the first capacitor C1 and the second capacitor C2. According to the equation (1): the difference between the main data signal voltage and the sub data signal voltage, i.e. the data signal voltage difference between the main area Main and the sub area Sub is influenced by the sizes of the first capacitor C1 and the second capacitor C2. The data signal voltage difference between the main area Main and the sub area Sub is altered by changing areas of the first capacitor C1 and the second capacitor C2.

In conclusion, the present invention provides a capacitive voltage dividing low color shift pixel circuit, which is electrically coupled to the main area of the sub pixel with a data signal line and provides a main data signal voltage thereto, and the data signal line is coupled to a common electrode line via a first capacitor and a second capacitor in series, and a routing is led out between the first capacitor and the second capacitor, and is electrically coupled to the sub area and provides a sub data signal voltage thereto; with voltage dividing function of the first capacitor and the second capacitor, the sub data signal voltage is different from the main data signal voltage. It can be realized to input different data signal voltages to the main area and the sub area of the sub pixel with one data signal line to perform multi-domain display. The color shift issue of VA type liquid crystal display can be improved to reduce the manufacture cost of the liquid crystal panel under the premise without increasing the amounts of the data signal lines and the COFs.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A capacitive voltage dividing low color shift pixel circuit, and a plurality of sub pixels arranged in array in a liquid crystal panel, and each sub pixel is divided into a main area and a sub area; a scan line is electrically coupled to the main area and the sub area and provides a scan signal thereto; a data signal line is electrically coupled to the main area and provides a main data signal voltage thereto, and the data signal line is coupled to a common electrode line via a first capacitor and a second capacitor in series; a routing is led out between the first capacitor and the second capacitor, and is electrically coupled to the sub area and provides a sub data signal voltage different from the main data signal voltage thereto.

2. The capacitive voltage dividing low color shift pixel circuit according to claim 1, wherein the main area comprises a first thin film transistor, a first liquid crystal capacitor and a first storage capacitor; a gate of the first thin film transistor is electrically coupled to the scan line, and a source is electrically coupled to the data signal line; after the first liquid crystal capacitor and the first storage capacitor are coupled in parallel, one end is electrically coupled to a drain of the first thin film transistor and the other end is electrically coupled to a constant voltage.

3. The capacitive voltage dividing low color shift pixel circuit according to claim 1, wherein the sub area comprises a second thin film transistor, a second liquid crystal capacitor and a second storage capacitor; a gate of the second thin film transistor is electrically coupled to the scan line, and a source is electrically coupled to the routing; after the second liquid crystal capacitor and the second storage capacitor are coupled in parallel, one end is electrically coupled to a drain of the second thin film transistor and the other end is electrically coupled to a constant voltage.

4. The capacitive voltage dividing low color shift pixel circuit according to claim 1, wherein the main area and the sub area respectively comprises four domains.

5. The capacitive voltage dividing low color shift pixel circuit according to claim 4, wherein the data signal line provides the main data signal voltage to the four domains in the main area, and the routing provides the sub data signal voltage to the four domains in the sub area, and with voltage dividing function of the first capacitor and the second capacitor, the relationship of the main data signal voltage and the sub data signal voltage is:

$$V\text{sub}=(C1/(C1+C2))\times(V\text{main}-V\text{com})+V\text{com}$$

wherein Vsub represents the sub data signal voltage, and Vmain represents the main data signal voltage, and C1 represents the first capacitor, and C2 represents the second capacitor, and Vcom represents the common electrode voltage.

6. The capacitive voltage dividing low color shift pixel circuit according to claim 1, wherein the first capacitor and the second capacitor are formed by a second metal layer and a first metal layer.

7. The capacitive voltage dividing low color shift pixel circuit according to claim 1, wherein the first capacitor and the second capacitor are formed by an ITO pixel electrode and a first metal layer.

8. The capacitive voltage dividing low color shift pixel circuit according to claim 1, wherein sizes of the first capacitor and the second capacitor are respectively determined by areas of the first capacitor and the second capacitor.

9. The capacitive voltage dividing low color shift pixel circuit according to claim 8, wherein a data signal voltage difference between the main area and the sub area is altered by changing areas of the first capacitor and the second capacitor.

10. A capacitive voltage dividing low color shift pixel circuit, and a plurality of sub pixels arranged in array in a liquid crystal panel, and each sub pixel is divided into a main area and a sub area; a scan line is electrically coupled to the main area and the sub area and provides a scan signal thereto; a data signal line is electrically coupled to the main area and provides a main data signal voltage thereto, and the data signal line is coupled to a common electrode line via a first capacitor and a second capacitor in series; a routing is led out between the first capacitor and the second capacitor, and is electrically coupled to the sub area and provides a sub data signal voltage different from the main data signal voltage thereto;

wherein the main area comprises a first thin film transistor, a first liquid crystal capacitor and a first storage capacitor; a gate of the first thin film transistor is electrically coupled to the scan line, and a source is electrically coupled to the data signal line; after the first liquid crystal capacitor and the first storage capacitor are coupled in parallel, one end is electrically coupled to a drain of the first thin film transistor and the other end is electrically coupled to a constant voltage;

wherein the sub area comprises a second thin film transistor, a second liquid crystal capacitor and a second storage capacitor; a gate of the second thin film transistor is electrically coupled to the scan line, and a source is electrically coupled to the routing; after the second liquid crystal capacitor and the second storage capacitor are coupled in parallel, one end is electrically coupled to a drain of the second thin film transistor and the other end is electrically coupled to a constant voltage.

11. The capacitive voltage dividing low color shift pixel circuit according to claim 10, wherein the main area and the sub area respectively comprises four domains.

12. The capacitive voltage dividing low color shift pixel circuit according to claim 11, wherein the data signal line provides the main data signal voltage to the four domains in the main area, and the routing provides the sub data signal voltage to the four domains in the sub area, and with voltage dividing function of the first capacitor and the second capacitor, the relationship of the main data signal voltage and the sub data signal voltage is:

$$V\text{sub}=(C1/(C1+C2))\times(V\text{main}-V\text{com})+V\text{com}$$

wherein Vsub represents the sub data signal voltage, and Vmain represents the main data signal voltage, and C1 represents the first capacitor, and C2 represents the second capacitor, and Vcom represents the common electrode voltage.

13. The capacitive voltage dividing low color shift pixel circuit according to claim 10, wherein the first capacitor and the second capacitor are formed by a second metal layer and a first metal layer.

14. The capacitive voltage dividing low color shift pixel circuit according to claim 10, wherein the first capacitor and the second capacitor are formed by an ITO pixel electrode and a first metal layer.

15. The capacitive voltage dividing low color shift pixel circuit according to claim 10, wherein sizes of the first capacitor and the second capacitor are respectively determined by areas of the first capacitor and the second capacitor.

16. The capacitive voltage dividing low color shift pixel circuit according to claim 15, wherein a data signal voltage difference between the main area and the sub area is altered by changing areas of the first capacitor and the second capacitor.

* * * * *